US007199525B2

(12) United States Patent
Brady

(10) Patent No.: US 7,199,525 B2
(45) Date of Patent: Apr. 3, 2007

(54) STRAPPED MAGNETRON WITH A DIELECTRIC RESONATOR FOR ABSORBING RADIATION

(75) Inventor: Michael Barry Clive Brady, Maldon (GB)

(73) Assignee: E2V Technologies (UK) Limited, Essex (GB)

( * ) Notice: Subject to any disclaimer, the term of this patent is extended or adjusted under 35 U.S.C. 154(b) by 36 days.

(21) Appl. No.: 10/941,072

(22) Filed: Sep. 15, 2004

(65) Prior Publication Data

US 2005/0104523 A1 May 19, 2005

Related U.S. Application Data

(63) Continuation-in-part of application No. 10/467,836, filed on Dec. 10, 2003, now abandoned, and a continuation-in-part of application No. PCT/GB03/01108, filed on Mar. 17, 2003, said application No. 10/467,836 filed as application No. PCT/GB02/00652 on Feb. 13, 2002.

(30) Foreign Application Priority Data

Feb. 13, 2001 (GB) ..... 0103530.2
Mar. 16, 2002 (GB) ..... 0206242.0

(51) Int. Cl.
*H01J 25/50* (2006.01)

(52) U.S. Cl. ..... 315/39.69; 315/39.75

(58) Field of Classification Search ..... 315/39.51, 315/39.71, 39.75, 39.77, 39.69
See application file for complete search history.

(56) References Cited

U.S. PATENT DOCUMENTS

| | | | | |
|---|---|---|---|---|
| 3,379,926 A | | 4/1968 | Symes | |
| 3,395,314 A | * | 7/1968 | Decker | 315/39.75 |
| 3,471,744 A | * | 10/1969 | Pryor | 315/39.77 |
| 3,706,910 A | | 12/1972 | Foreman | |
| 4,420,710 A | * | 12/1983 | Pickering | 315/39.77 |
| 5,422,542 A | * | 6/1995 | Schaeffer | 315/39.71 |

FOREIGN PATENT DOCUMENTS

| | | |
|---|---|---|
| GB | 1 570 417 A | 7/1980 |
| GB | 2 372 147 A | 8/2002 |
| JP | 53-112052 | 9/1978 |
| JP | 62-119836 A | 6/1987 |
| JP | 63-40234 A | 2/1988 |
| JP | 8-162030 A | 6/1996 |

* cited by examiner

*Primary Examiner*—Benny T. Lee
(74) *Attorney, Agent, or Firm*—Venable, LLP; Robert Kinberg; Jeffri Kaminski

(57) ABSTRACT

A magnetron includes an anode having at least one vane defining a plurality of cavities and a dielectric resonator in communication with the at least one vane. The dielectric resonator is arranged to at least partially absorb radiation generated in a predetermined mode of operation of the magnetron.

22 Claims, 6 Drawing Sheets

STRAPPED MAGNETRON WITH A DIELECTRIC RESONATOR FOR ABSORBING RADIATION

CROSS REFERENCE TO RELATED APPLICATION

This application is a continuation-in-part of PCT/GB03/01108, filed Mar. 17, 2003, designating the United States and claiming priority from British Application No. 0206242.0 filed Mar. 16, 2002, and as well is a continuation-in-part of U.S. National Stage application Ser. No. 10/467,836, filed Dec. 10, 2003 now abandoned, based on PCT/GB02/00652 filed Feb. 13, 2002 and claiming priority from British Application No. GB 0103530.2 filed Feb. 13, 2001. All of the foregoing applications are incorporated herein by reference.

BACKGROUND OF THE INVENTION

This invention relates to magnetrons.

In one known magnetron design, a central cylindrical cathode is surrounded by an anode structure which typically comprises a conductive cylinder supporting a plurality of anode vanes extending inwardly from its interior surface. During operation, a magnetic field is applied in a direction parallel to the longitudinal axis of the cylindrical structure and, in combination with the electrical field between the cathode and anode, acts on electrons emitted by the cathode, resulting in resonances occurring and the generation of r,f energy. A magnetron is capable of supporting several modes of oscillation depending on the coupling between the cavities defined by the anode vanes, giving variations in the output frequency and power. The mode of operation which is usually required is the so-called pi mode of operation.

It is desirable to be able to suppress the transmission of power generated in certain modes, for example, the so-called pi−1 mode. It has been discovered that power generated in this mode, if transmitted, may interfere with other electronic devices such as mobile phones, satellite links and other communication systems. Various methods have been proposed to suppress this mode of operation but these have generally been found to be costly, complicated, and also to suppress radiation in desired modes of operation, for example the pi mode. The invention arose from work relating to magnetrons for marine radar applications. Such magnetrons are small, simple and low cost devices and therefore a low cost and straightforward solution to the problem of pi-I radiation was sought.

SUMMARY OF THE INVENTION

According to one aspect of the invention there is provided a mechanism for attenuating radiation generated by a magnetron, wherein a dielectric material is provided in communication with at least one anode vane of the magnetron which results in the absorption of spurious radiation.

Preferably, a portion of the dielectric resonator is lossy.

The provision of partly lossy dielectric material in communication with the vane or vanes results in the absorption of spurious radiation.

Preferably, the predetermined mode is the pi−1 mode. The absorption of radiation generated in this mode prevents interference with other electronic devices.

Preferably, the lossy portion of the resonator is located further from the anode vane than the other portion. This arrangement is advantageous because electric fields associated with the pi mode do not penetrate into the resonator as deeply as those fields associated with the pi−1 mode. Thus, electrical energy generated in the pi−1 mode is attenuated more than energy generated in the pi mode by virtue of the distal lossy portion.

Advantageously, the lossy portion of the resonator is thinner than the other portion, for example one quarter or less of the thickness of the other portion.

Improved performance of the invention can be achieved by the introduction of an electrically conductive region interposed between the lossy portion and the other portion.

The resonator may comprise two annular members, one of which is lossy. The annuli may be coaxial. A further annulus of electrically conductive material may be interposed between the lossy and non-lossy members in order to achieve the improved performance mentioned above.

The dielectric resonator may include ceramics material, for example alumina. The lossy portion may be of ceramic material loaded with carbon.

The resonator may be annular and co-axial with the vanes of the anode.

DETAILED DESCRIPTION OF THE INVENTION

Figure 1:
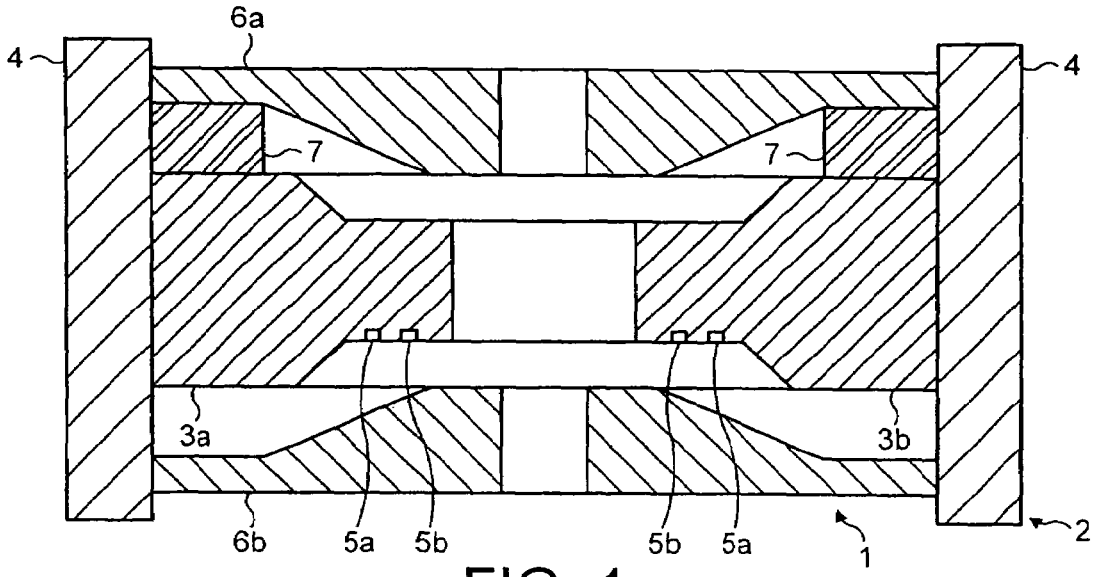
FIG. 1 is a cross-sectional view of a magnetron constructed according to a first embodiment of the invention.

The invention will be described in relation to two embodiments. In a first embodiment, as shown in FIGS. 1 to 4, a dielectric resonator is arranged to absorb radiation generated in a predetermined mode (preferably the pi−1 mode). In this embodiment, the mechanism for absorbing radiation involves creating a resonance such that resistive losses in the dielectric resonator absorb the unwanted radiation. In a second embodiment, as shown in FIGS. 5 to 9, a dielectric resonator has a portion which is lossy. In this embodiment, the mechanism for absorbing radiation involves the lossy portion being arranged so as to absorb primarily only the unwanted mode of oscillation, but such that little of the desired mode penetrates the lossy portion.

Like reference numerals have been used for like parts in the first and second embodiments.

With reference to FIG. 1, the basic features of a conventional magnetron, indicated generally by the reference numeral 1, are shown. However, the cathode of the magnetron 1 is not shown for clarity; this electrode would normally be located at the center of the magnetron. The main basic features include an anode 2 having a plurality of vanes 3, two of which 3*a*, 3*b*, are visible in this drawing. When viewed from above, the vanes are evenly spaced around the inner circumference of the cylindrical portion 4 of the anode 2, and extend inwardly from it, such that a plurality of resonant cavities are formed. The vanes 3*a*, 3*b*, are connected to alternate others of the vanes by means of straps 5*a*, 5*b*. Straps are used in order to increase the frequency separation of different modes of operation of the magnetron. In the desired pi mode of operation, alternate anode vanes are at the same r.f, potential. Thus, if alternate vanes are connected together by straps, no additional inductance will be introduced because the ends of the straps are at the same potentials. The straps add capacitance to the circuit, and so the pi mode frequency is altered. In modes other than the pi mode, the voltage difference between alternate anode vanes is not zero, and so the straps introduce inductance as well as capacitance resulting in different frequency shifts than occur for the mode. Thus, undesired modes are removed in frequency from the pi mode. The magnetron 1 also comprises pole pieces 6*a*, 6*b* arranged to produce magnetic fields required for operation of the magnetron.

In accordance with the first embodiment of the invention, the magnetron further comprises a dielectric resonator 7, The resonator 7 comprises an annulus, or washer, of ceramic material. The resonator 7 is located in a space in the magnetron between an end portion of the anode vanes 3 and one of the pole pieces 6*a*, such that it is in communication with the plurality of vanes, including the vanes 3*a*, 3*b*. The resonator is also shown in communication with one of the pole pieces 6*a*, but it need not be so. The invention has been found to work even when the pole piece is spaced from the resonator. The resonator contacts the anode vanes 3*a*, 3*b* at an end portion remote from the strapped end. It has been found by the inventor that the beneficial effects of the invention are greatly enhanced when the resonator is in communication with this end portion of the vanes as opposed to the strapped end portion.

The resonator 7 is arranged to absorb radiation generated in an unwanted mode of operation of the magnetron, such as the pi−1 mode and thereby suppress transmission of power in this mode. The mechanism by which the resonator suppresses the pi−1 mode is complex but a brief summary is given below.

The resonator, in the form of a ceramic washer, has a number of resonances which occur when the average perimeter of the washer equates to an integral number "n" of guide wavelengths. The electromagnetic resonances of the magnetron anode and the mramlc washer have a symmetry about the axes of the magnetron and the ceramic, with periodic variations of electric and magnetic field in azimuth. When two circuits share a common localized region of field, then there is coupling between the circuits, which can be represented by mutual induction in an equivalent circuit model. Where the common fields of the resonances all have azimuthal symmetry about the magnetron axis, it is evident that coupling only exists between resonances which have the same number of periods in azimuth, as well as commonality in position and resonant frequency. Otherwise, the coupling by the different regions will cancel due to symmetry. In the case of the ceramic washer located above the end of the anode, the common fields are the magnetic fields above the backs of the anode cavities. For the resonances of the ceramic, the magnetic fields vary sinusoidally in azimuth with "n" cycles, where "n" is the resonance number. For the anode resonances, the currents circulating round the backs of the cavities have the same periodicity as the voltages around the anode surface.

At the ends of the anode, the axial magnetic field in each cavity divides over the end of the vanes to return down the next cavities, i.e. have the same periodicity in azimuth.

Thus, the diameters of a ceramic washer of high dielectric constant can be chosen such that the n=1 resonance between the vane ends and the pole piece face can be made to coincide in frequency with the pi−1 resonance of the anode. These two resonances are strongly coupled together by common azimuthal n=1 magnetic field at the outer diameter, so that the resistive losses in the ceramic resonance are transformed into a comparatively large series resistance in the pi−1 resonance, giving a low Q. Since in the pi mode there is no strap current other than local capacity currents, there is no zero mode component of the magnetic fields to couple to the n=0 ceramic resonance.

Figure 2:
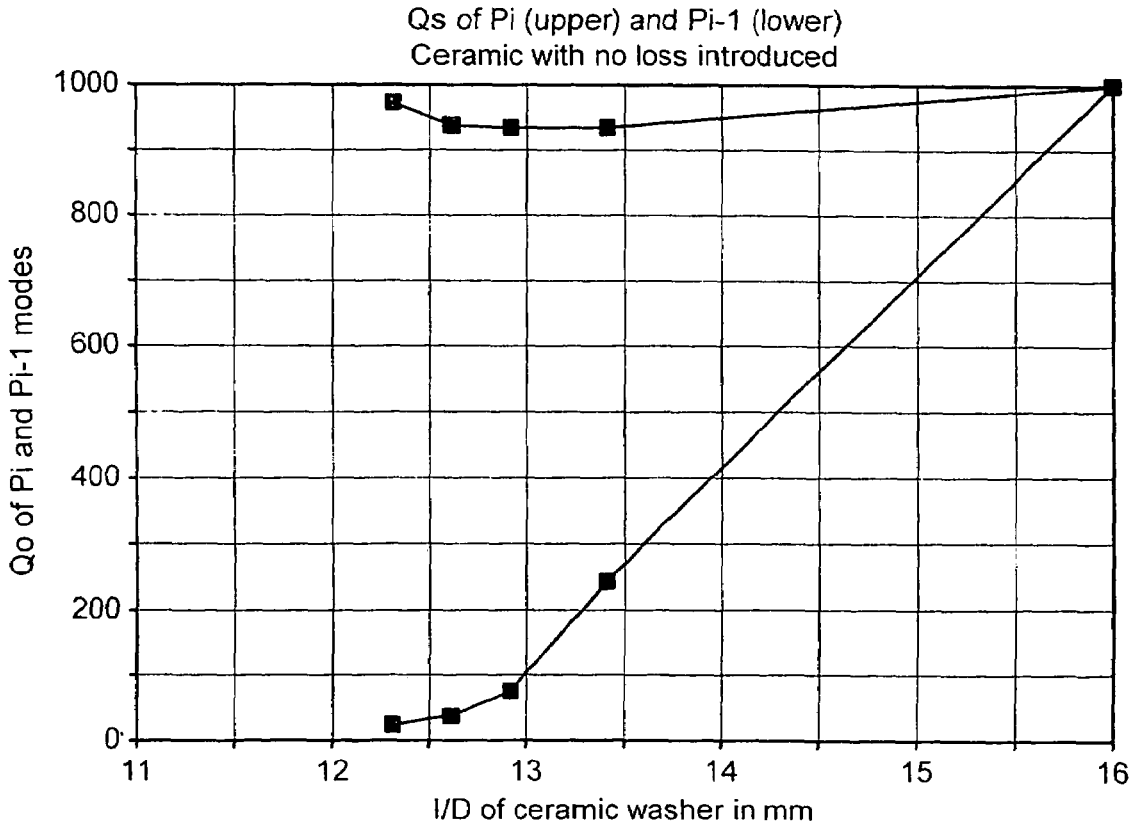
FIG. 2 is a graph of experimental data, showing the change in Q of the pi and pi−1 modes of the magnetron of FIG. 1.
Figure 3:
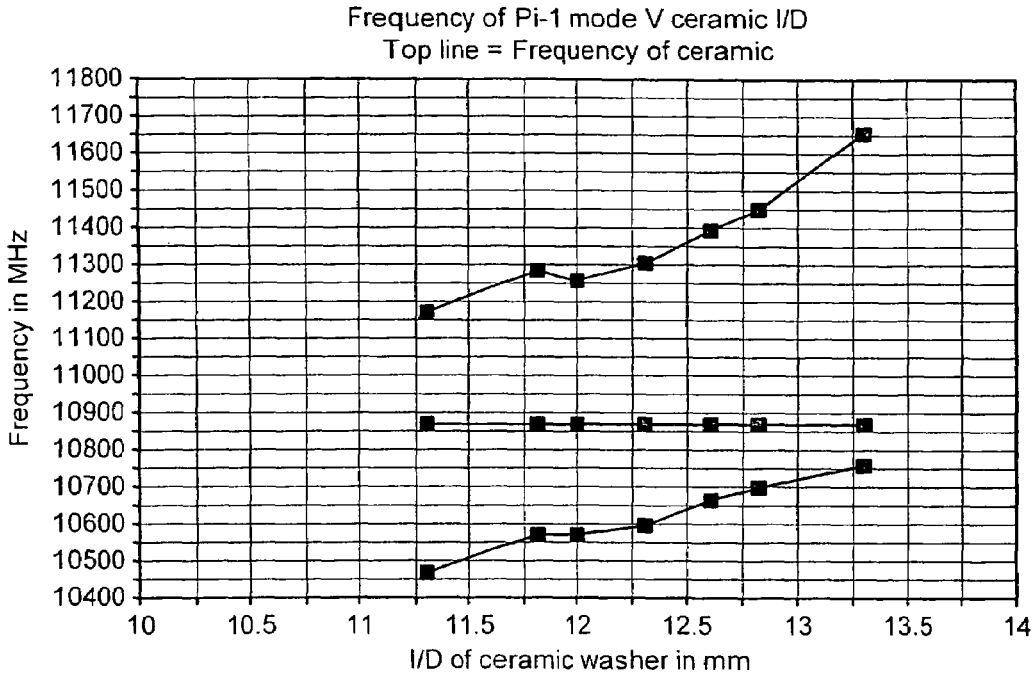
FIG. 3 is a graph of experimental data, showing the change in frequency of the pi−1 mode of the magnetron of FIG. 1.
Figure 4:
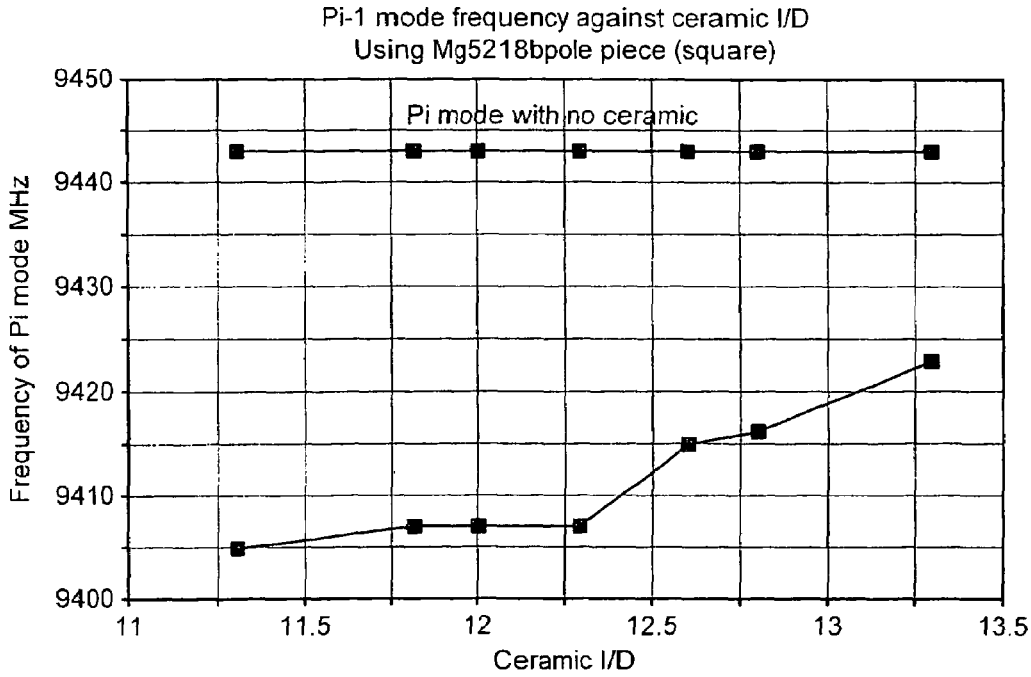
FIG. 4 is a graph of experimental data, showing the change of frequency of the pi mode of magnetron of FIG. 1.

FIGS. 2, 3 and 4 chart experimental data. Resonators of different internal diameter were made and various properties of the magnetron including these resonators, in different modes of operation, were monitored. For example, FIG. 2 charts the Q factor of the magnetron in two modes of operation. The Q factor varies with different internal diameters of dielectric washer. The upper line of FIG. 2 shows the Q factor of the pi mode of operation—this is the wanted mode of operation. The lower line shows the Q factor of the pi−1 mode of operation—this is the unwanted mode. The Q (or quality) factor of a resonant cavity is the ratio of energy stored to energy lost by dissipation. As is shown in FIG. 2, the Q of the wanted pi mode is only slightly reduced by the presence of the ceramic washer, a matter of a few percent. However, the Q of the pi−1 mode reduces when washers having smaller internal diameter are used.

When the value of the internal diameter of the washer falls below 12.5 mm, the Q of the pi−1 mode drops to barely detectable levels, meaning that the power produced by the magnetron in this mode is almost completely dissipated in the apparatus. The lower limit of the internal diameter of the ceramic washer is dictated by the size of the pole piece 6*a*. It has been proposed to make this pole piece narrower in order to accommodate washers of smaller internal diameter. It is hoped that this will further improve suppression of the pi−1 mode.

FIGS. 3 and 4 illustrate the changes in frequencies of the pi and pi−1 modes in the apparatus of the invention. With reference to FIG. 3, the uppermost line plots the change in resonant frequency of the ceramic washer itself for different internal diameters. The resonant frequency tends to decrease with decreasing size of the internal diameter of the washer. The central line illustrates the resonant frequency of the apparatus of the pi−1 mode in the absence of the ceramic washer. The lower line shows the frequency of the pi−1 mode when ceramic washers of different internal diameters are present. Overall, the frequency is reduced with a ceramic washer and the effect is more pronounced with washers of smaller internal diameter. The resonant frequency varies from 10.75 GHz with a 13.3 mm internal diameter washer to approximately 10.45 GHz with the 11.3 mm internal diameter washer whereas, without a resonator, the resonant frequency is approximately 10.85 GHz.

With reference to FIG. 4, the frequency of the pi mode without ceramic is shown by the upper line on the chart. The resonant frequency is just above 9.44 GHz. The presence of a ceramic causes the resonant frequency of the pi mode to change by a few MHz—from 9.425 GHz with a 13.3 mm washer to 9.405 GHz with an 11.3 mm washer. This can be accommodated for by slight adjustments to the operating system of the magnetron, and is within the capabilities of the skilled person.

A suitable ceramic for the resonator is alumina. This may be loaded in order to mace me material more lossy. The ceramic may be metallised on one or more surfaces. As ceramic washers may be manufactured cheaply in bulk, the inventor's solution to the problem of spurious radiation is both low-cost and simple. The cost of the resonator is typically very low, a few cents, and the fitting of the resonator in the magnetron is uncomplicated, so that there is no appreciable increase in manufacturing and labor.

Although the invention was devised in relation to low power magnetrons, it is thought that it could readily apply to high power magnetrons. The invention has been discussed in relation to magnetrons having an anode strapped at one end region of the vanes, in which the effect of the resonator is most pronounced. The inventor has considered the application of the principles of the invention to anodes strapped at both end portions of the vanes. For this type of magnetron, it has been proposed to use a ceramic cylinder, a quarter (dielectric) wavelength long, and having an outside diameter the same as the backs of the cavities. Axial metallic strips or rods extend inside the cylinder for a length about a quarter dielectric wavelength from the ends of the vanes, being open at the far end. These form a coupled resonant circuit. This arrangement could be used at one or both ends of the anode. The strips could be metallised on the inner surface of the ceramic. This requires an axially deep end space, or a pole piece which extends inside the ceramic.

Further variations may be made without departing from the scope of the invention. For example, dielectric resonator need not be an annulus and need not be of a closed shape. Furthermore, the dielectric resonator need not contact all of the vanes.

Figure 5:
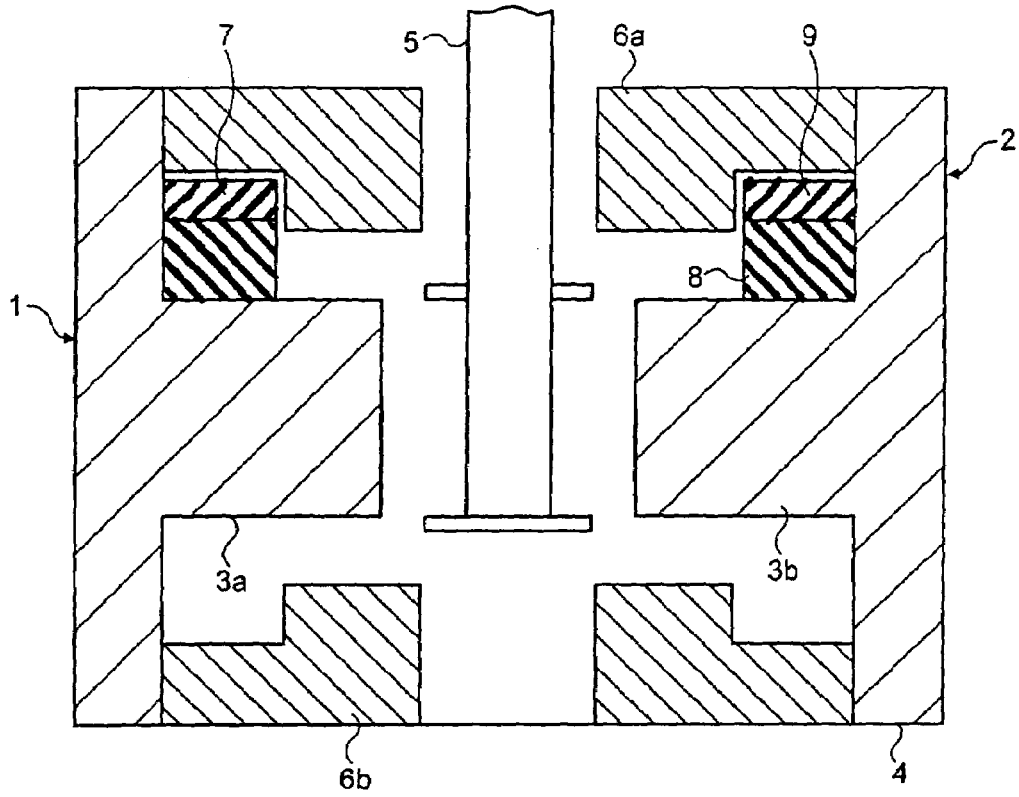
FIG. 5 is a cross-sectional view of a magnetron constructed according to a second embodiment of the invention.

With reference to FIG. 5, the basic features of a magnetron adopted according to the second embodiment, indicated generally by the reference numeral 1, are shown. The main basic features include an anode 2 having a plurality of vanes 3, two of which 3*a*, 3*b*, are visible in this drawing. When viewed from above, the vanes are evenly spaced around the inner circumference of the cylindrical portion 4 of the anode 2, and extend inwardly from it, such that a plurality of resonant cavities are formed. The magnetron also includes a central cathode 5, which is surrounded by the anode 2. The magnetron 1 also comprises pole pieces 6*a*, 6*b* arranged to produce magnetic fields required for operation of the magnetron. The anode vanes may be strapped, but straps are not shown in this drawing.

In accordance with the second embodiment of the invention, the magnetron further comprises a dielectric resonator between an end portion of the anode vanes 3 and one of the pole pieces 6*a*, such that it is in communication with the plurality of vanes, including the vanes 3*a*, 3*b*. The resonator is also shown in communication with one of the pole pieces 6*a*, but it need not be so. The invention has been found to work even when the pole piece is spaced from the resonator 7.

In this embodiment, the resonator 7 is realized in the form of two annular members 8 and 9. The annular members 8, 9 are substantially coaxial and are in intimate contact, although a small degree of separation is allowable. Annulus 8 is of a substantially lossless plain ceramic material; annulus 9 is of lossy material, such as ceramic loaded with carbon powder. The annuli 8,9 are arranged so that the loss-free annulus 8 is interposed between the anode vanes 3*a*, 3*b* and the lossy annulus 9. The anode vanes 3*a*, 3*b*, and the annuli 8, 9 are also substantially coaxial.

The dimensions of the annuli 8, 9 are predetermined so that the annuli resonate in the so-called TM110 mode as a dielectric resonator. The resonator 7 is arranged to attenuate radiation generated in an unwanted mode of operation of the magnetron, such as the pi−1 mode, by magnetically coupling into the anode and thereby suppressing transmission of power in this mode.

Figure 6:
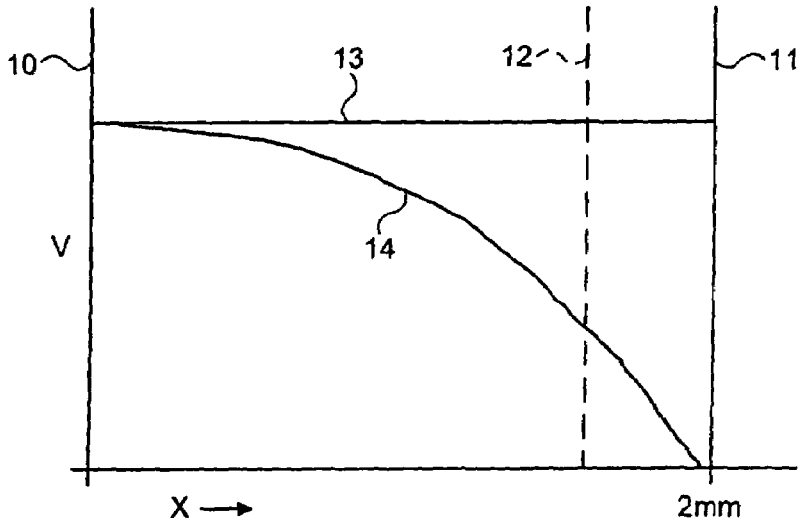
FIG. 6 is a graph of experimental data, showing the change in electric field with position, of the pi and pi−1 modes of the magnetron of FIG. 5.

Referring now to FIG. 6, this is a graph showing field strength "V" plotted against position "x" along the thickness of the resonator. The vertical axis 10 represents the position at which the anode vane meets the resonator and the vertical axis 11 represents the position at which the resonator meets the pole piece. Vertical axis 12 represents the junction of the lossy and non-lossy of the resonator.

The upper line 13 represents the penetration of the TM110 field in the pi−1 mode into the resonator. The electric field is high throughout the depth of the resonator, even into the lossy portion. Therefore, the lossy ceramic acts on almost the entire field of the pi−1 mode. The diameters of the annuli are chosen such that a resonance is set up in the resonator in the TM 110 mode, which coincides in frequency with the pi−1 resonance of the anode. These two resonances are strongly coupled together by a common azimuthal magnetic field at the outer diameter, so that the resistive losses in the ceramic resonance are transformed into a comparatively large series resistance in the pi−1 resonance, giving a low Q. In this manner the pi−1 mode is attenuated.

The other line 14 on this chart represents the penetration of the fringing field in the pi mode. Very little of the field enters the lossy portion of the resonator, and so only a portion of the field is suppressed in the pi mode, typically less than 20%. However, it is preferable to minimise reduction of the fields generated in the pi mode: hence a magnetron according to FIG. 7 may be employed.

Figure 7:
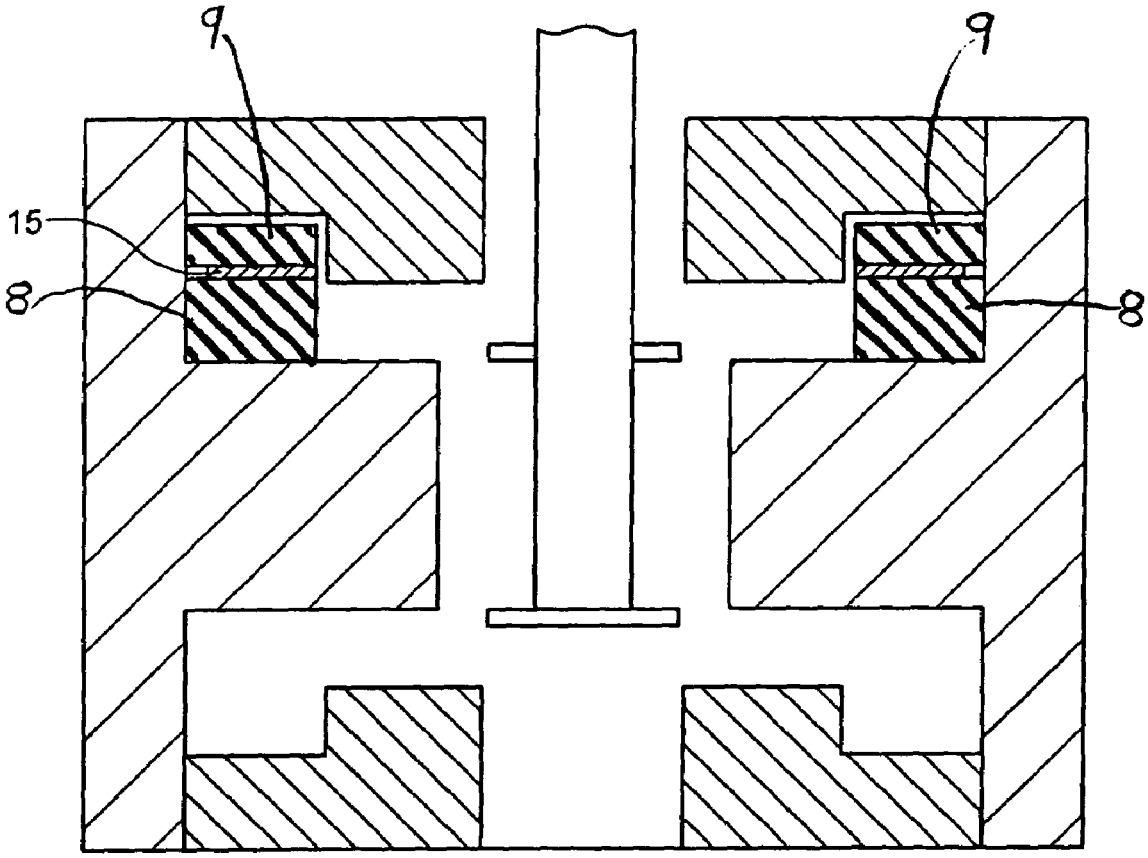
FIG. 7 is a cross-sectional view of an alternative magnetron constructed according to the second embodiment of the invention.

The magnetron illustrated in FIG. 7 has the same features as does the magnetron of FIG. 5, but with the inclusion of a thin metal annulus 15, interposed between the loss-free annulus 8 and the lossy annulus 9.

Figure 8A:
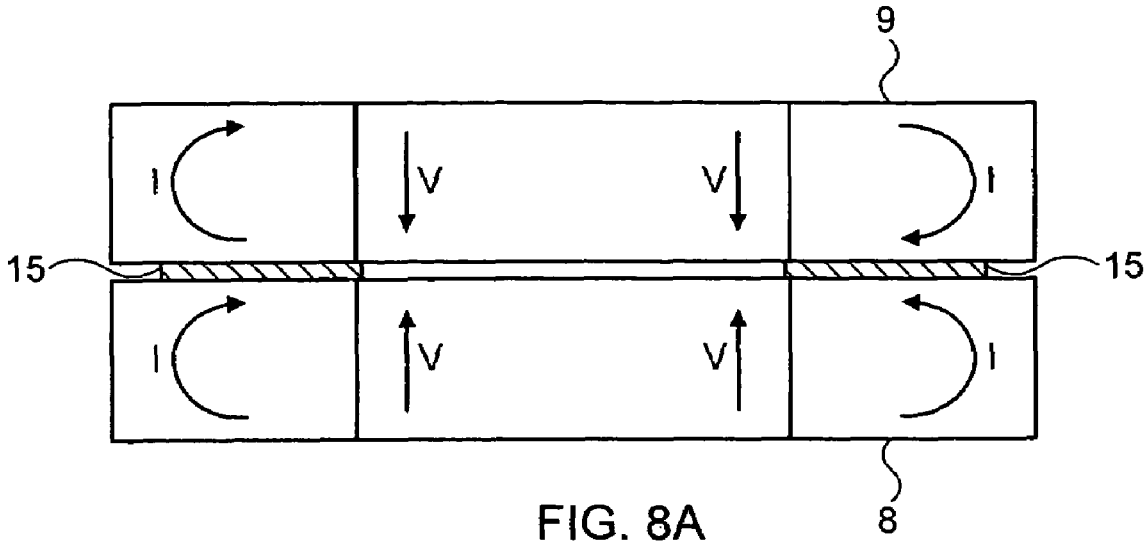
FIG. 8*a* is a sectional view and FIG. 8*b* a plan view of the resonator of FIG. 7.
Figure 8B:
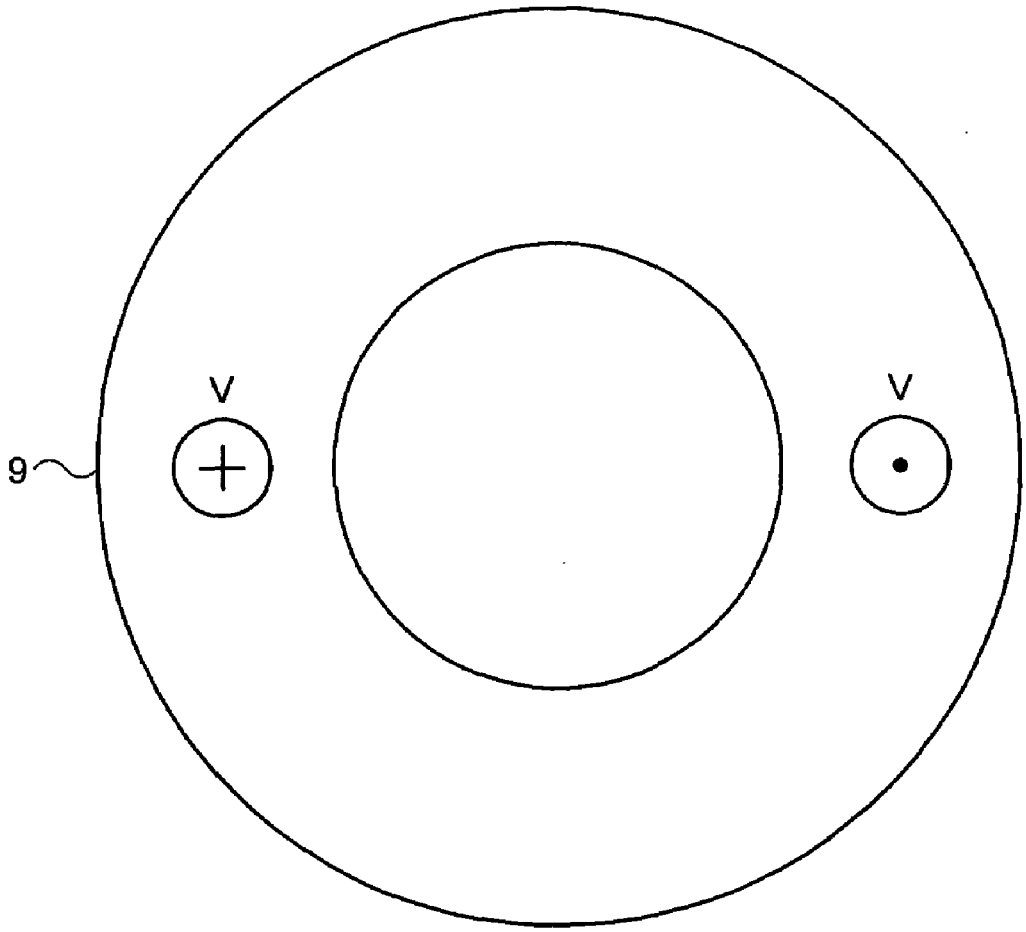

FIG. 8*a* illustrates the resonator of FIG. 7 in section and also shows the electric fields and currents (I) set up in the resonator in the TM 110 mode. FIG. 88 is a plan view of the resonator. The TMI 10 mode is set up in the lossy annulus 9. The loss-free annulus couples the pi-I mode to the lossy annulus. The metal ring 15 (see FIG. 8A) has a smaller outer diameter than the ceramic annuli and so allows improved magnetic coupling between the resonances in the lossy annulus and the plain annulus so that the pi-I mode is attenuated as before. The TMI 10 currents will flow around the outside diameter of the ceramics where the metal ring does not interrupt them. The pi mode residual field is substantially reduced, and may be brought to zero by the metallic ring. The effect of this metal washer 15 is also shown in the graph of FIG. 9.

Figure 9:
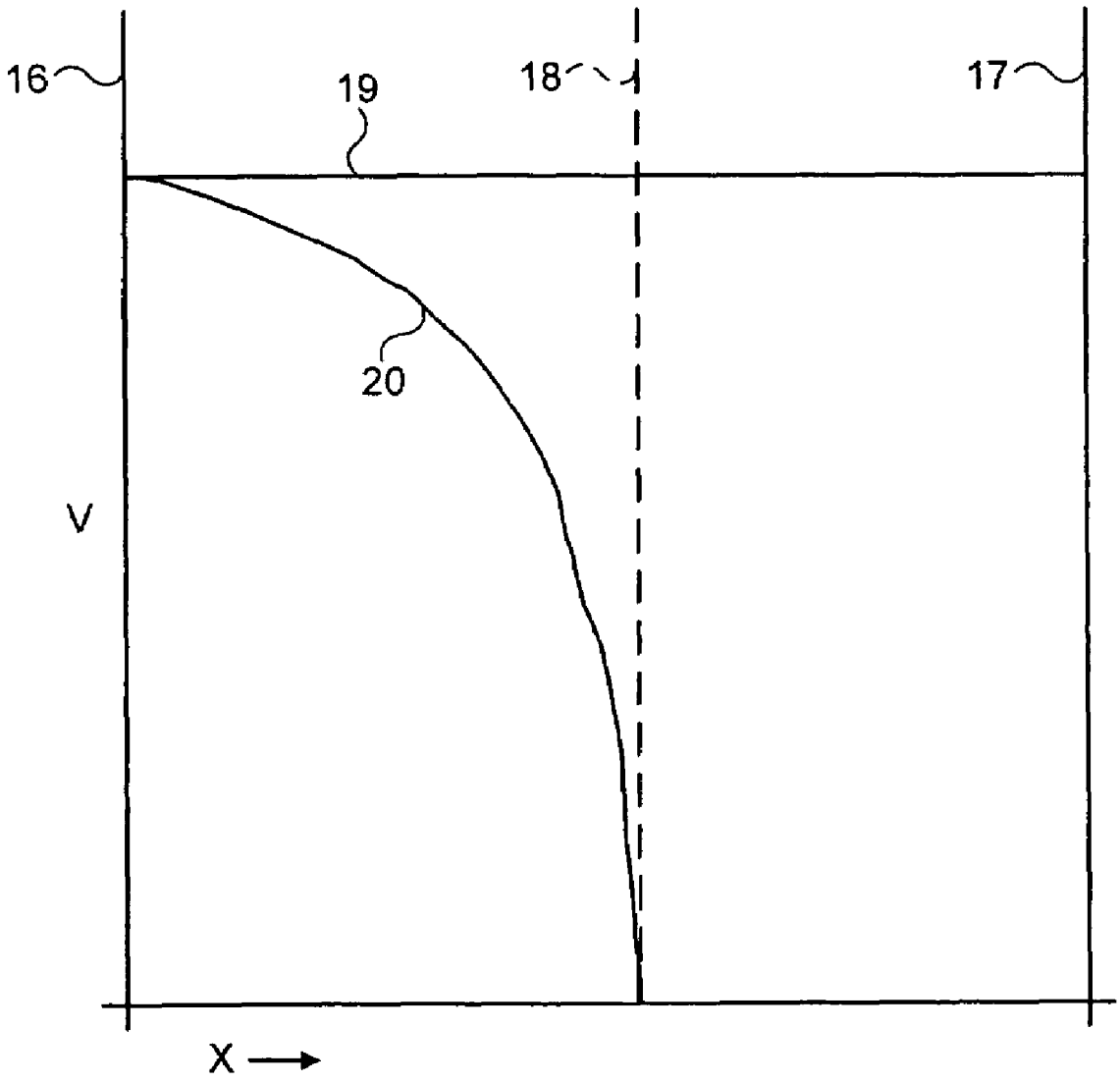
FIG. 9 is a graph of experimental data, showing the change in electric field with position, of the pi and pi−1 modes of the magnetron of FIG. 7.

FIG. 9 shows the depth into the resonator of the fringing field of the pi mode and the TM110 field of the pi−1 mode. The vertical axis 16 represents the position at which the anode vane meets the resonator and the vertical axis 17 represents the position at which the resonator meets the pole piece. The vertical line 18 represents the position of the metal annulus 15. The horizontal line 19 on this chart plots the strength of fields generated in the pi−1 mode and illustrates that these fields enter the resonator up to and including the lossy portion. Thus, the lossy ceramic is able to act on the residual field and attenuate it. The line 20 plots the strength of field generated in the pi mode. The field strength dips sharply when the field encounters the metal annulus, so that only a minute portion of the field enters the lossy portion of the resonator.

Employing the magnetron arrangement of FIG. 7, it is possible to reduce the Qo (quality factor) of the pi-I mode from 1000 to a figure in the region of 50. However, the change in the pi mode is negligible—a change in Qo from 1000 to approximately 950. This can be accommodated for by slight adjustments to the operating system of the magnetron, and is within the capabilities of the skilled person.

Preferably, the metal washer has an external diameter less than those of the annuli 8, 9. This feature allows magnetic coupling between the lossy annulus and the loss-free annulus. The metallic annulus may be in the form of a metal layer on a surface of one of the annuli 8, 9 or may be formed by metalizing both the upper annulus 9 and lower annulus 8. Although the invention has been described in relation to a resonator comprising a plurality of pieces, the resonator may comprise a single piece having different lossy characteristics in different regions of the resonator.

A suitable ceramic for the resonator is alumina, although any vacuum—compatible insulator may be employed. As ceramic washers may be manufactured cheaply in bulk, the inventor's solution to the problem of spurious radiation is both low-cost and simple. The cost of the resonator is typically very low, a few cents, and the fitting of the resonator in the magnetron is uncomplicated, so that there is no appreciable increase in manufacturing and labor costs.

Although the invention was devised in relation to low power magnetrons, it is thought that it could readily apply to high power magnetrons. A conventional strapped anode vane magnetron has been described, but the resonator could be used in conjunction with a rising sun-type magnetron, for example. Further variations may be made without departing from the scope of the invention. For example, the dielectric resonator need not be an annulus and need not be of a closed shape. Furthermore, the dielectric resonator need not contact all of the vanes.

The invention claimed is:

1. A strapped magnetron comprising an anode having a plurality of vanes defining a plurality of cavities and a dielectric resonator in communication with the plurality of vanes, the dielectric resonator being arrange to at least partially absorb radiation generated in a predetermined mode of operation of the magnetron.

2. A strapped magnetron as claimed in claim 1, in which each of the vanes are disposed about a common axis, the dielectric resonator is annular and is substantially coaxial with each of the vanes.

3. A strapped magnetron as claimed in claim 1, wherein the dielectric resonator has dimensions which are such that a predetermined resonance between each of the vanes and a pole piece of the magnetron is substantially equal to a frequency of the predetermined mode of operation.

4. A strapped magnetron as claimed in claim 1, in which the predetermined mode of operation is the pi−1 mode.

5. A strapped magnetron as claimed in claim 1, in which the dielectric resonator is comprised of ceramic material.

6. A strapped magnetron as claimed in claim 5, in which the ceramic material is alumina.

7. A strapped magnetron as claimed in claim 1, in which the dielectric resonator comprises a first portion and a second portion and the first portion of the dielectric resonator is lossy.

8. A strapped magnetron as claimed in claim 7, in which each of the vanes are disposed about a common axis and the resonator is substantially co-axial with each of the vanes.

9. A strapped magnetron as claimed in claim 7, in which the predetermined mode of operation is the pi−1 mode.

10. A strapped magnetron as claimed in claim 7, in which the first portion of the dielectric resonator comprises a first annular member and the second portion comprises a second annular member, the first and second annular members being substantially coaxial.

11. A strapped magnetron as claimed in claim 10, further comprising a third member of electrically conductive material sandwiched between the first and second annular members.

12. A strapped magnetron as claimed in claim 11, in which the third member is annular and substantially coaxial with the first and second members.

13. A strapped magnetron as claimed in claim 7, in which the dielectric resonator includes ceramic material.

14. A strapped magnetron as claimed in claim 13, in which the ceramic material is alumina.

15. A strapped magnetron as claimed in claim 13, in which the first lossy portion which is lossy comprises ceramic material loaded with carbon.

16. A strapped magnetron as claimed in claim 7, in which the first lossy portion of the resonator is located further from the anode vane than the second portion.

17. A strapped magnetron as claimed in claim 7, in which the first lossy portion of the resonator is thinner than the second portion.

18. A strapped magnetron as claimed in claim 17, in which the first lossy portion of the resonator has a thickness less than one quarter of that of the second portion.

19. A strapped magnetron as claimed in claim 7, further comprising an electrically conductive region interposed between the first portion and the second portion.

20. A strapped magnetron comprising an anode having a plurality of vanes defining a plurality of cavities and a dielectric resonator in communication with the plurality of vanes, the dielectric resonator being arranged to at least partially absorb radiation generated in a predetermined mode of operation of the magnetron in which the dielectric resonator comprises a first portion and a second portion and the first portion of the dielectric resonator is lossy and an electrically conductive region interposed between the first portion and the second portion.

21. A strapped magnetron comprising an anode having a plurality of vanes defining a plurality of cavities and a dielectric resonator in communication with at least one of the vanes the dielectric resonator being arranged, in use, to at least partially absorb radiation generated in a predetermined mode of operation of the magnetron.

22. A strapped magnetron as claimed in claim 21, in which a portion of the dielectric resonator is lossy.

* * * * *